US005797534A

United States Patent [19]

Almeras et al.

[11] Patent Number: 5,797,534

[45] Date of Patent: Aug. 25, 1998

[54] PLUG DRIVING APPARATUS WITH A RISER RETURNING AUTOMATICALLY TO THE FIRING POSITION

[75] Inventors: Roland Almeras; Patrick Herelier, both of Tournon, France

[73] Assignee: Societe de Prospection et d'Inventions Techniques (S.P.I.T.), Bourg-les-Valence, France

[21] Appl. No.: 825,038

[22] Filed: Mar. 26, 1997

[30] Foreign Application Priority Data

Mar. 26, 1996 [FR] France ..... 96 03722

[51] Int. Cl.[6] ..... B25C 1/14

[52] U.S. Cl. ..... 227/10; 227/130

[58] Field of Search ..... 227/9, 10, 11, 227/130; 173/211, 212, 206, 207; 123/465 C

[56] References Cited

U.S. PATENT DOCUMENTS

| | | | |
|---|---|---|---|
| 2,877,750 | 3/1959 | Maier . | |
| 3,323,705 | 6/1967 | Grotsch et al. . | |
| 3,678,808 | 7/1972 | Hsu et al. | 227/10 |
| 4,122,987 | 10/1978 | Jochum et al. . | |
| 4,196,834 | 4/1980 | Beton . | |
| 4,358,041 | 11/1982 | Ollivier . | |
| 4,711,385 | 12/1987 | Jochum | 227/10 |
| 4,824,003 | 4/1989 | Almeras et al. . | |
| 5,090,606 | 2/1992 | Torii et al. | 227/10 |
| 5,170,922 | 12/1992 | Ehmig et al. | 227/10 |
| 5,191,861 | 3/1993 | Kellerman et al. | 227/10 |
| 5,538,172 | 7/1996 | Jochum et al. . | |
| 5,680,980 | 10/1997 | Robinson | 227/10 |

FOREIGN PATENT DOCUMENTS 460557 4/1975 Australia .

*Primary Examiner*—S. Smith
*Attorney, Agent, or Firm*—Schwartz & Weinrieb

[57] ABSTRACT

The apparatus comprises along the riser (10) a return chamber with a front space (30) and a rear space (22) adapted to communicate with the combustion chamber (15) following a first displacement of the riser (10). Once the two spaces (30, 22) have been brought into communication with one another, they are separated from one another and the riser (10) is returned towards the rear in the barrel (9). The two spaces (30) and (22) communicate with one another during the displacement of the riser (10) and the rear space (22) is separated from, the front space (30) following a second forward displacement of the riser (10). As the rear space (22) communicates with the exterior of the apparatus, the expansion of the combustion gases trapped in the front space (30) then returns the riser (10) towards the rear into the firing position.

The apparatus serves to fix components to a support material.

16 Claims, 6 Drawing Sheets

PLUG DRIVING APPARATUS WITH A RISER RETURNING AUTOMATICALLY TO THE FIRING POSITION

FIELD OF THE INVENTION

This invention relates to a plug driving apparatus for fixing a component to a support material by means of a riser adapted to be propelled fowardly within a barrel by the action of combustion gases from a cartridge disposed in a combustion chamber in the barrel and comprising along the barrel a return chamber with a front space closed by a front surface of the riser and a rear space adapted to communicate with the combustion chamber following a first forward displacement of the riser in order that, after having brought the two spaces into communication with one another, the rear space is separated from the front space, the riser being returned towards the rear in the barrel.

BACKGROUND OF THE INVENTION

Apparatus of the foregoing kind is already known from European Patent No. 0 223 740. However, in the apparatus of this document, the two rear and front spaces can only be separated from one another following the relative displacement of a guide sleeve for the plug and a support tube, that is, during recoil of the apparatus or if the apparatus is provided with a breech which can recoil by the action of the combustion gases. If the operator holds the apparatus tightly during firing, the apparatus will not recoil and it is not very easy to provide an apparatus with a movable breech. Moreover, if there is no recoil of the apparatus or the breech, the gas pressures in the two front and rear spaces will balance out with no escape of the gases towards the exterior of the apparatus, so that the riser can adopt any position.

OBJECT OF THE INVENTION

This invention aims to simplify apparatus of the foregoing kind in order to eliminate the afore noted disadvantages.

SUMMARY OF THE INVENTION

To this end, the invention relates to an apparatus of the type defined hereinabove, characterised in that the two front and rear spaces communicate with one another during the displacement of the riser and the rear space is separated from the front space following a second forward displacement of the riser, after which, as the rear space communicates with the exterior of the apparatus, the expansion of the combustion gases trapped in the front space returns the riser towards the rear into the firing position.

Therefore, in the apparatus of the invention it is the riser and only the riser that acts as a valve, thereby ensuring that the riser returns to the firing position.

In a first embodiment of the apparatus of the invention the return chamber is formed directly between the riser and the barrel, the riser includes a head provided with a rear skirt on the outer periphery of which the rear space is formed and which is provided with at least one passage for communication between this rear space and the combustion chamber, and the barrel is provided with at least one inner communicating groove, following intermediate displacement, between the two front and rear spaces.

In this case, the inner communicating groove of the barrel extends axially over a length equal to the difference between the second displacement and the intermediate displacement of the riser increased by the axial thickness of the riser head.

The combustion chamber of the barrel is also preferably extended into a nozzle projecting towards the front and adapted to be introduced into the rear skirt of the riser head.

In a second embodiment of the apparatus of the invention the rear space of the return chamber includes a passage for communication between the combustion chamber and the front space, formed in the barrel, and the riser head is adapted to uncover a rear opening in the passage of the barrel following the first displacement and to cover a front opening in the passage following the second displacement.

The riser advantageously includes a head extended by a lengthening piece projecting towards the rear and adapted to be introduced into the combustion chamber.

BRIEF DESCRIPTION OF THE DRAWINGS

The invention will be more readily understood with the aid of the following description of two embodiments of the apparatus with reference to the accompanying drawings, in which like or corresponding parts are designated by similar reference characters throughout the several views, and wherein.

DETAILED DESCRIPTION OF THE ILLUSTRATED EMBODIMENTS

Figure 1:
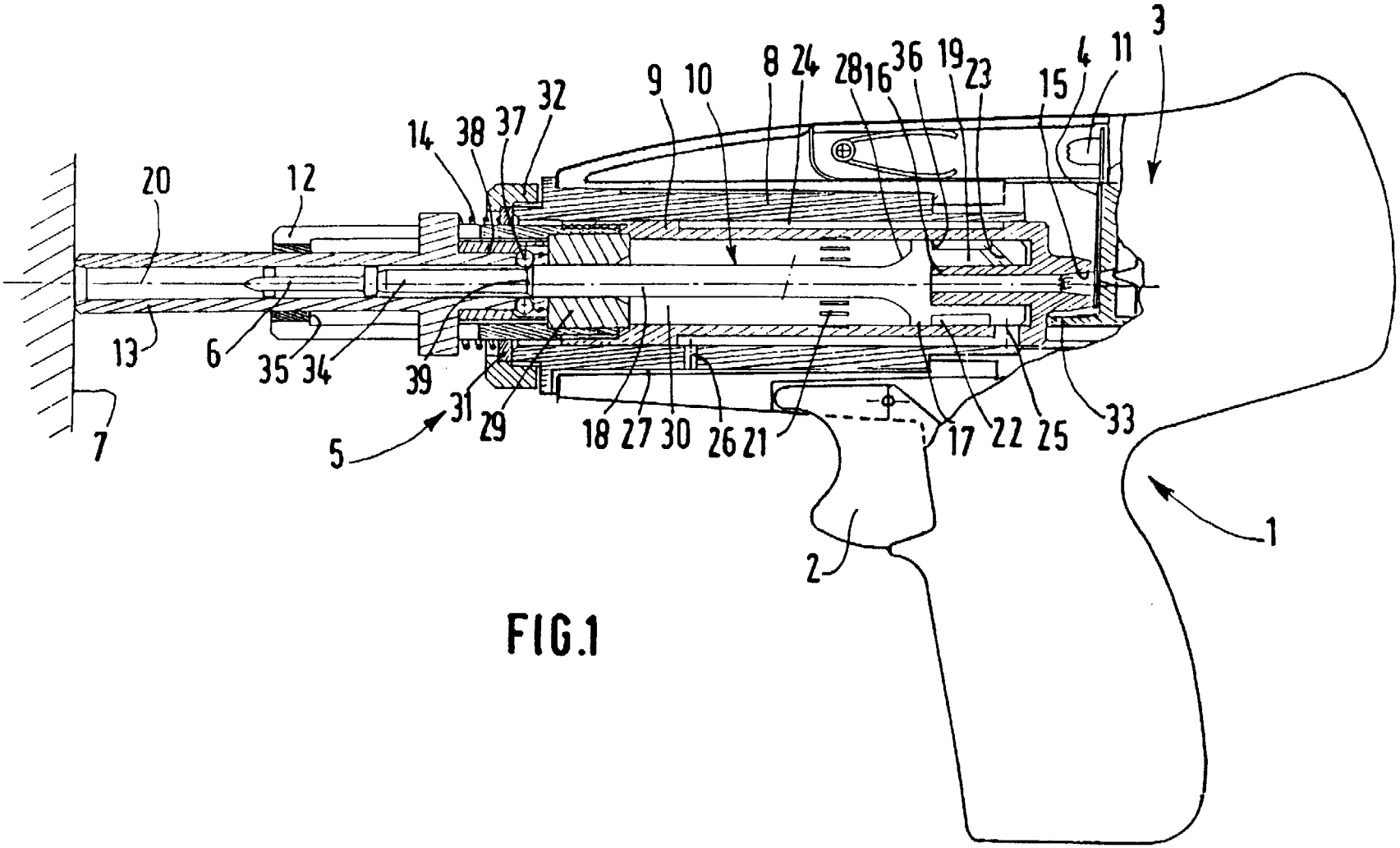
FIG. 1 is an axial section of the first embodiment of the apparatus, just before firing.
Figure 2:
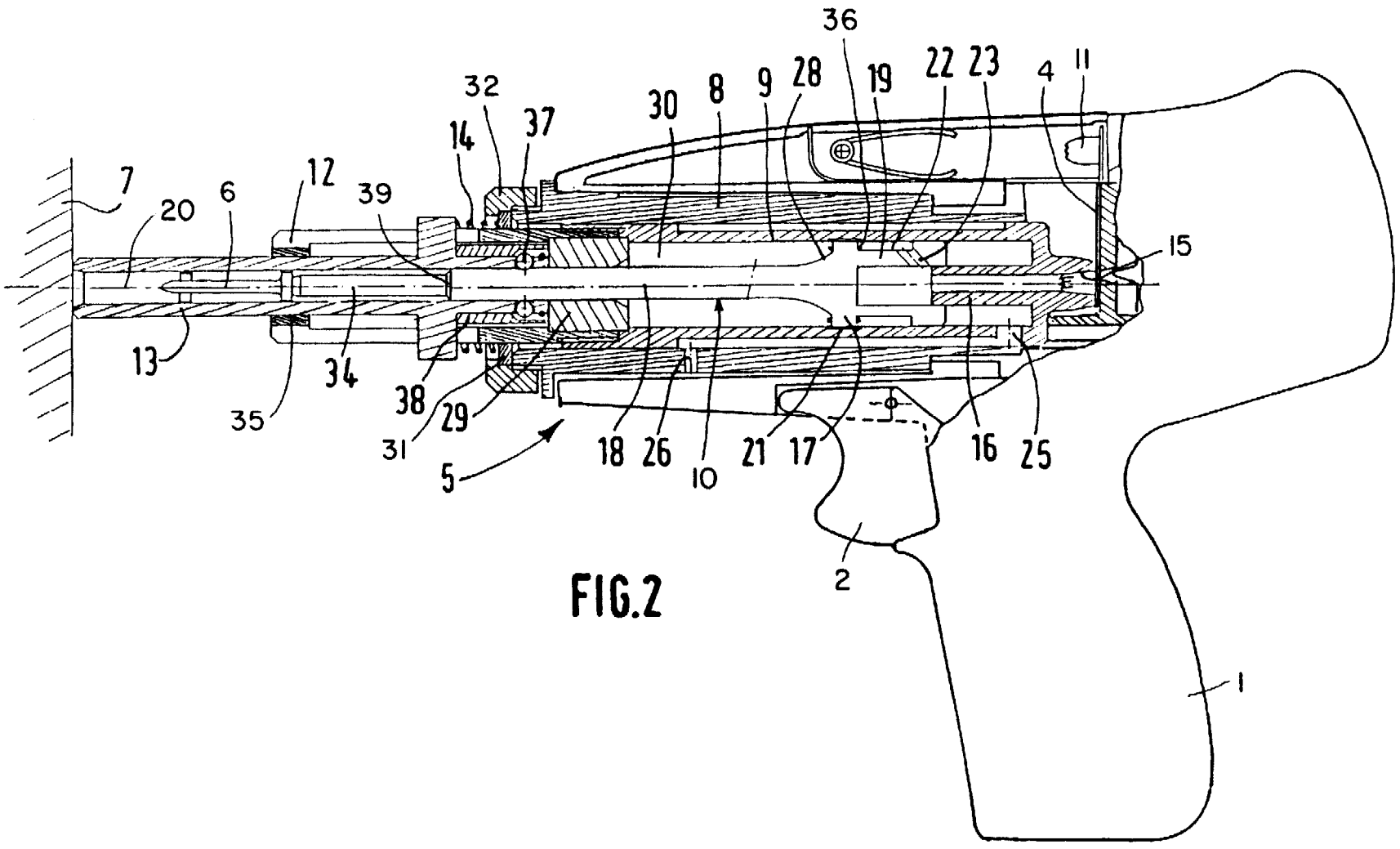
FIG. 2 is a view analogous to that of FIG. 1, the riser being in the intermediate position.
Figure 3:
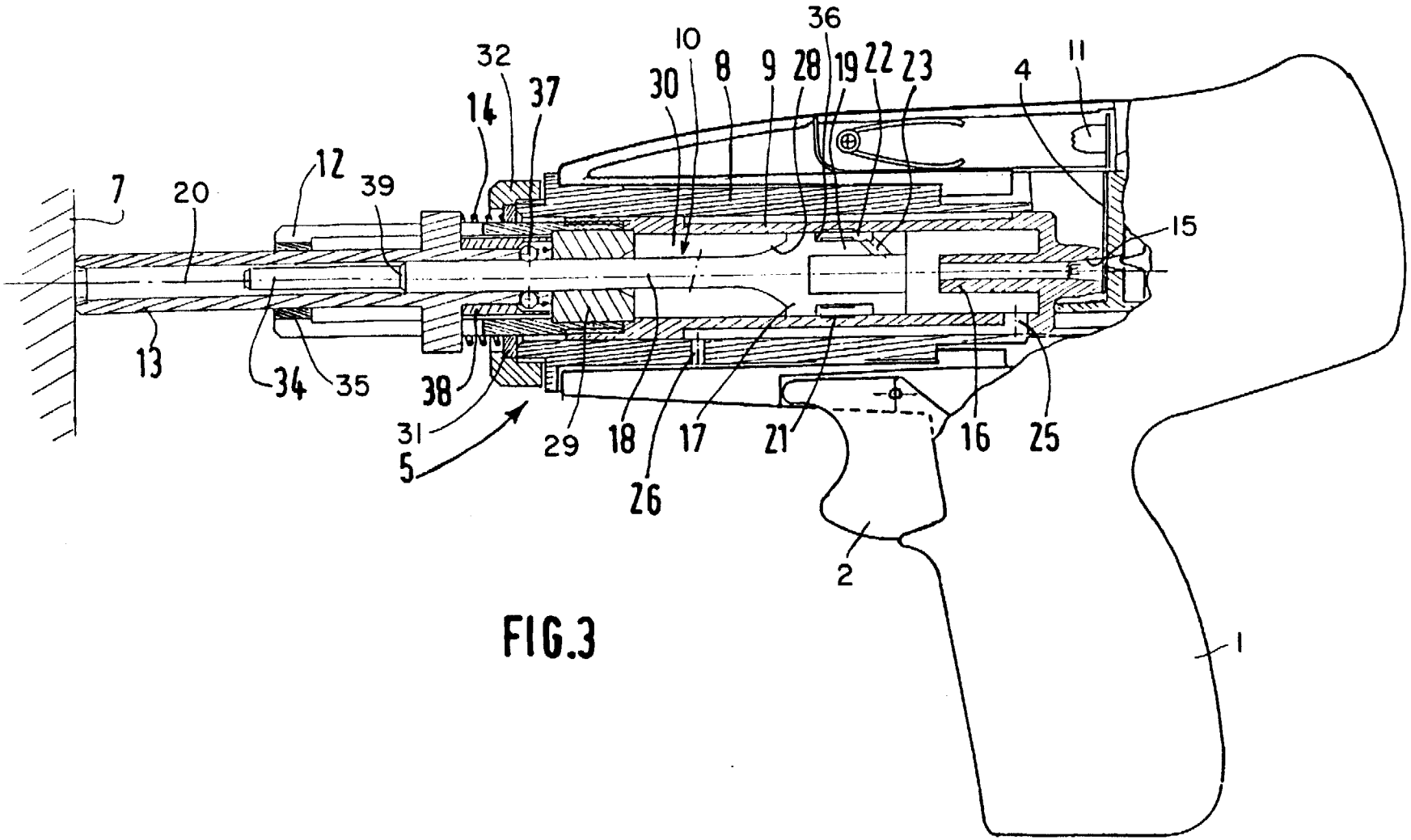
FIG. 3 is a view analogous to the preceding ones, following incomplete return of the riser and before the apparatus is put down.

The apparatus of FIGS. 1 to 3 includes, integral with a handle 1, a firing device 2, a percussion device 3, means (not shown) for receiving and driving, in this case, a cartridge 11, feeding disc 4, and a drive assembly 5 for fixing a plug 6 in a support material 7.

The drive assembly 5 includes, in a cylindrical tube 8 mounted in the handle 1, a barrel 9 having an axis 20, a riser 10 movably disposed within the barrel 9, a guide support 12 and, in the support 12, a plug guide 13.

A damping member 29 for the riser 10 is disposed at the front of the barrel 9 and at the rear of the guide support 12.

A combustion chamber 15 is situated at the rear of the barrel 9 and is extended into an inner sleeve 16 in the form of a nozzle projecting towards the front in the main part of the barrel 9.

The riser 10 includes a head 17, a front rod 18 and a rear skirt 19 into the interior of which the inner sleeve 16 of the barrel 9 can be introduced.

A plurality of axial grooves 21 are formed on the inner periphery of the barrel 9 at a point and over a length which will be described hereinafter. The rear skirt 19 of the riser 10 includes an annular outer lateral recess 22 so that the outer diameter of the skirt 19 is smaller than the diameter of the head 17 and this skirt 19 is provided in its rear part with a passage 23. Several of these passages could moreover be provided.

The barrel 9 also includes a longitudinal annular outer lateral recess 24 opening, on the one hand, into the interior in the barrel 9 by means of a passage 25 provided in the rear part of the barrel 9, in this case, along the axial length of the nozzle 16 and, on the other hand, to the exterior of the apparatus when it is in the open position by way of a passage 26 provided in the cylindrical barrel-holding tube 8 and a longitudinal annular outer lateral recess 27 formed on the tube 8.

When formed in this manner, the barrel 9 and the riser 10 define a riser return chamber along the riser 10, in this case around it, with a front space and a rear space.

The front space 30 is formed between the riser rod 18 and the part of the barrel a forwardly the grooves 21. It is closed by the front surface 28 of the riser head 17.

The rear space is formed essentially by the annular recess 22 around the riser skirt 19.

The rear space 22 of the return chamber can communicate with the combustion chamber 15 by means of the passage 23 and the two front 30 and rear spaces 22 can communicate with one another by means of the barrel grooves 21.

Operation of the Apparatus

The barrel 9 can slide in the barrel-holding tube 8, between a front position bearing against a washer 31 at the bottom of a ring 32 screwed on to the tube 8 and a rear position bearing against a front stop 33 of the housing of the feeder 4.

The riser 10 can slide into the bore of the plug guide 13 by means of a tapered front portion 34 of its rod 18.

It can slide within the barrel 9 by means of its head 17 and on the inner sleeve 16 of the barrel by means of the skirt 19. The plug guide 13 can slide in its support 12 between the damping member 29 and the front bottom 35 of the support 12, by or against the action of a spring 14.

Once a fixing plug 6 has been introduced into the plug guide 13 and cartridges 11 have been placed on the feeder 4, the apparatus is brought to bear against the support 7. The plug guide 13 slides towards the rear, compresses the spring 14, comes to a stop against the damping member 29 and thus guides the barrel 9 towards the rear, thereby activating the firing system 2 and positioning a cartridge 11 in the combustion chamber 15.

After firing, the gas pressure in the nozzle 16 rises and the riser 10 is thus propelled towards the front. When the rear surface 36 of the riser head 17 has travelled a first distance and thus the passage 23 of its rear skirt 19 is disposed immediately forwardly of the front end of the nozzle 16, the gases under high pressure begin to escape from the combustion chamber by means of the passage 23 towards the rear space 22 of the return chamber. As the riser 10 continues to travel, when the rear surface 36 of the riser head 17 arrives at the rear ends of the grooves 21, the two front 30 and rear spaces 22 are brought into communication with one another. All of the highly compressed gases available are directed towards the space 30. At this point, the riser 10 has travelled an intermediate distance since the beginning of its displacement. Referring above all to FIG. 2, it will be noted that this intermediate distance is only slightly greater than the first distance. It could moreover be envisaged that these two distances are equal. The combustion gases then escape towards the front space 30 until the riser 10 has travelled a second distance since the beginning of its propulsion and the front surface 28 arrives at the front ends of the grooves 21 whereas the riser 10 therefore separates the rear space 22 from the front space 30 like a valve.

It will be noted here that the grooves 21 extend axially over a length equal to the difference between the second displacement and the intermediate displacement of the riser 10 increased by the axial thickness of the riser head 17.

The riser 10 continues to travel towards the front, compressing the gases trapped in the front space 30 until, firstly, the riser rear skirt 19 frees the passage 25 provided in the barrel 9 and allows for the escape of the gases from the rear space 22 towards the atmosphere, the plug 6 then being fixed in the support 7 by the riser's own energy (FIG. 3).

The riser 10 is then returned towards the rear into the firing position under the pressure of the gases in the front space 30, return being facilitated by the communication between the rear space 22 and the exterior of the apparatus.

Once the riser 10 has been returned to a position in which the passage 23 in the riser rear skirt 19 is again sealed off by the nozzle 16, some of the gases from the rear space 22 continue to escape by means of the passage 25 in the barrel 9, but an air cushion is formed at the rear of the riser 10, which can substantially slow down the return thereof.

When the apparatus is put down, the spring 14 returns the plug guide 13 and the barrel 9 towards the front and the feeder 4 moves forward one step and the plug guide 13 occupies a position in front of the untapered portion of the riser rod 18.

By virtue of return balls 37 in the plug guide 13 and a ring 38 in the guide support 12, when the apparatus is positioned once again, as the ring 38 is displaced slightly towards the rear in order to push the balls 37 against the tapered portion 34 of the riser rod 18 then against the annular shoulder 39 between the two rod portions, the riser 10 is driven completely towards the rear until it comes into contact with the feeder disc 4. As soon as the rear end of the ring 38 comes to a stop against the damping member 29, it is pushed back towards the front, thereby relieving the pressure of the balls 37 on the riser rod 18.

Figure 4:
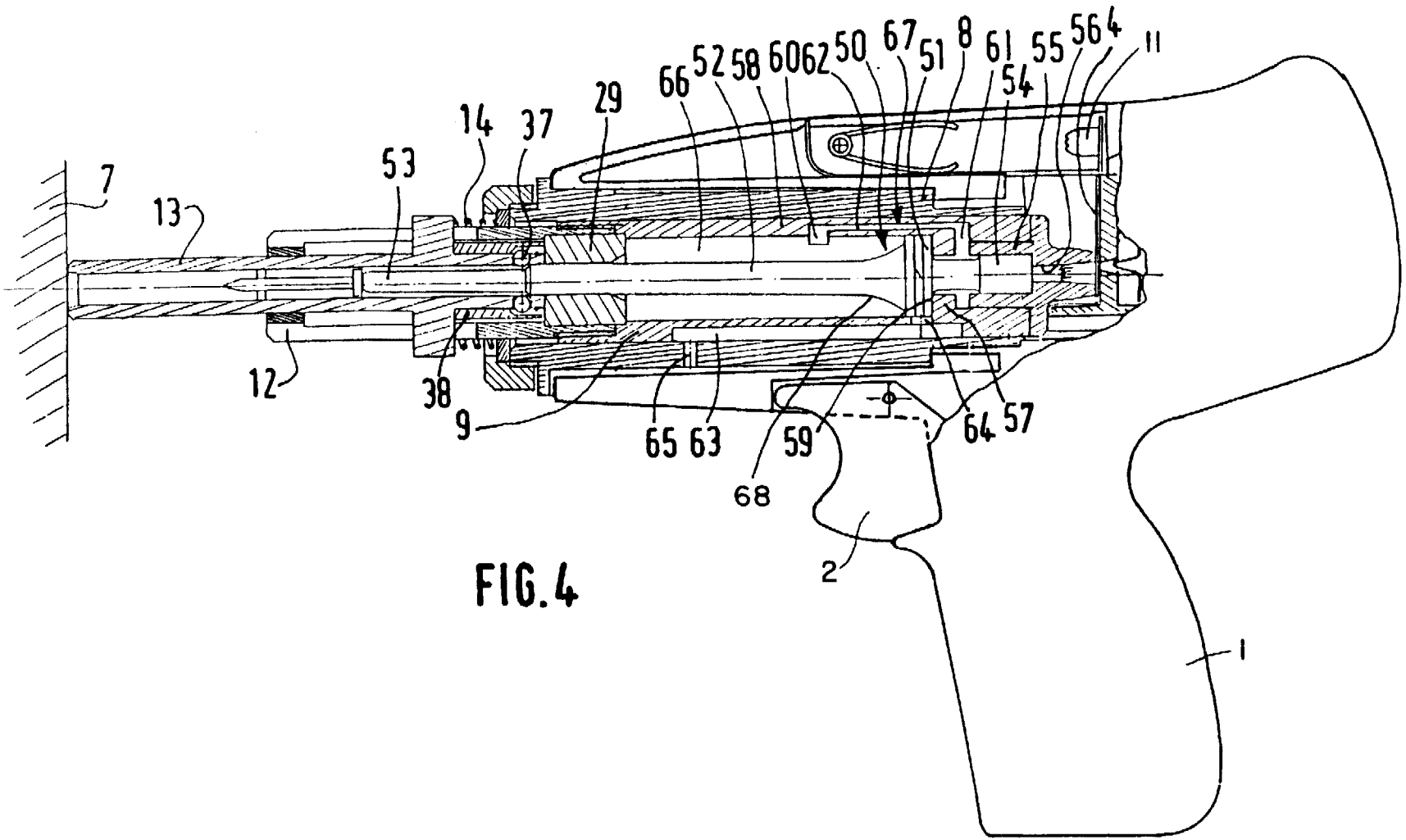
FIG. 4 is an axial section of the second embodiment of the apparatus, just before firing.
Figure 5:
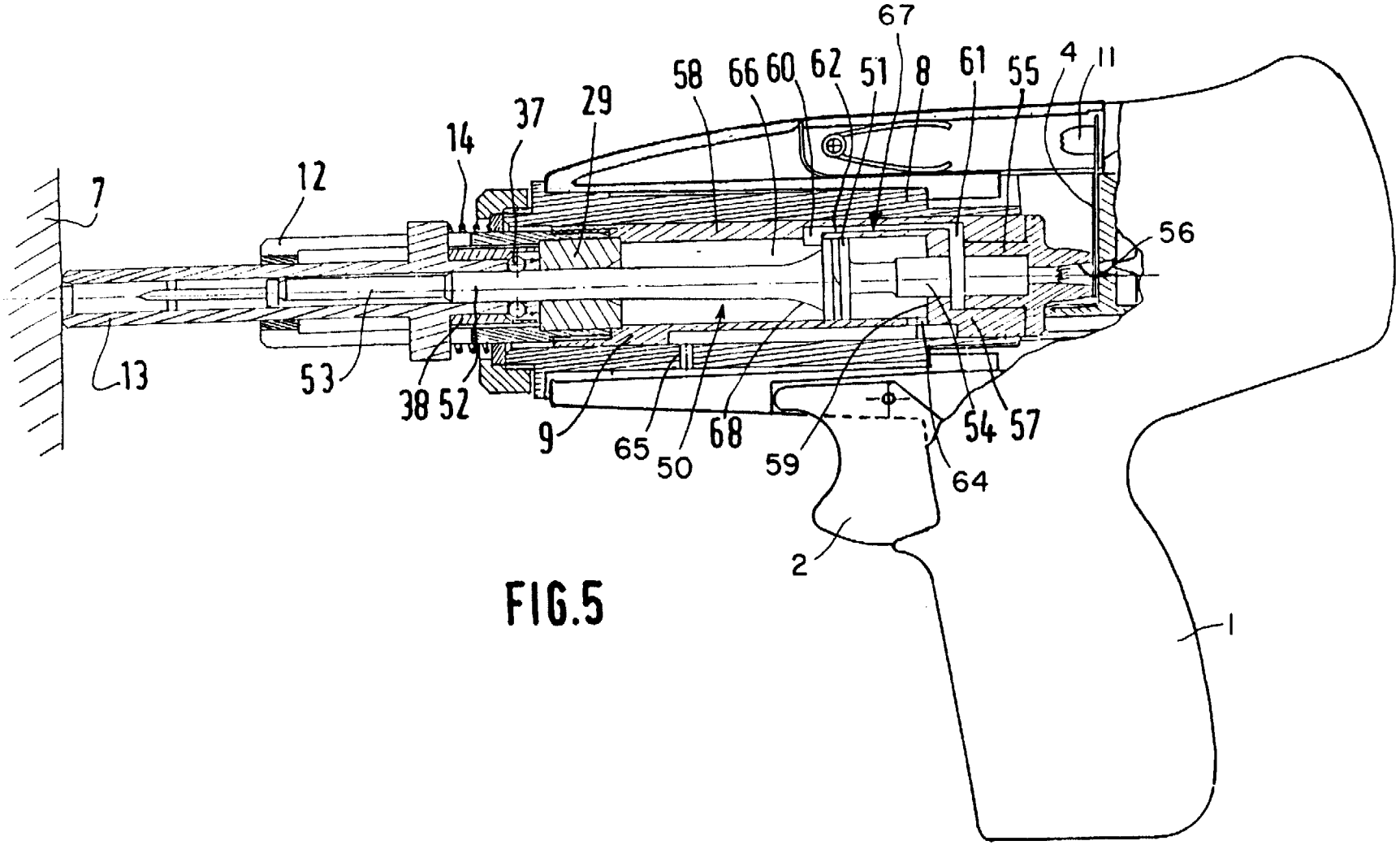
FIG. 5 is a view analogous to that of FIG. 2, the riser being in the intermediate position.
Figure 6:
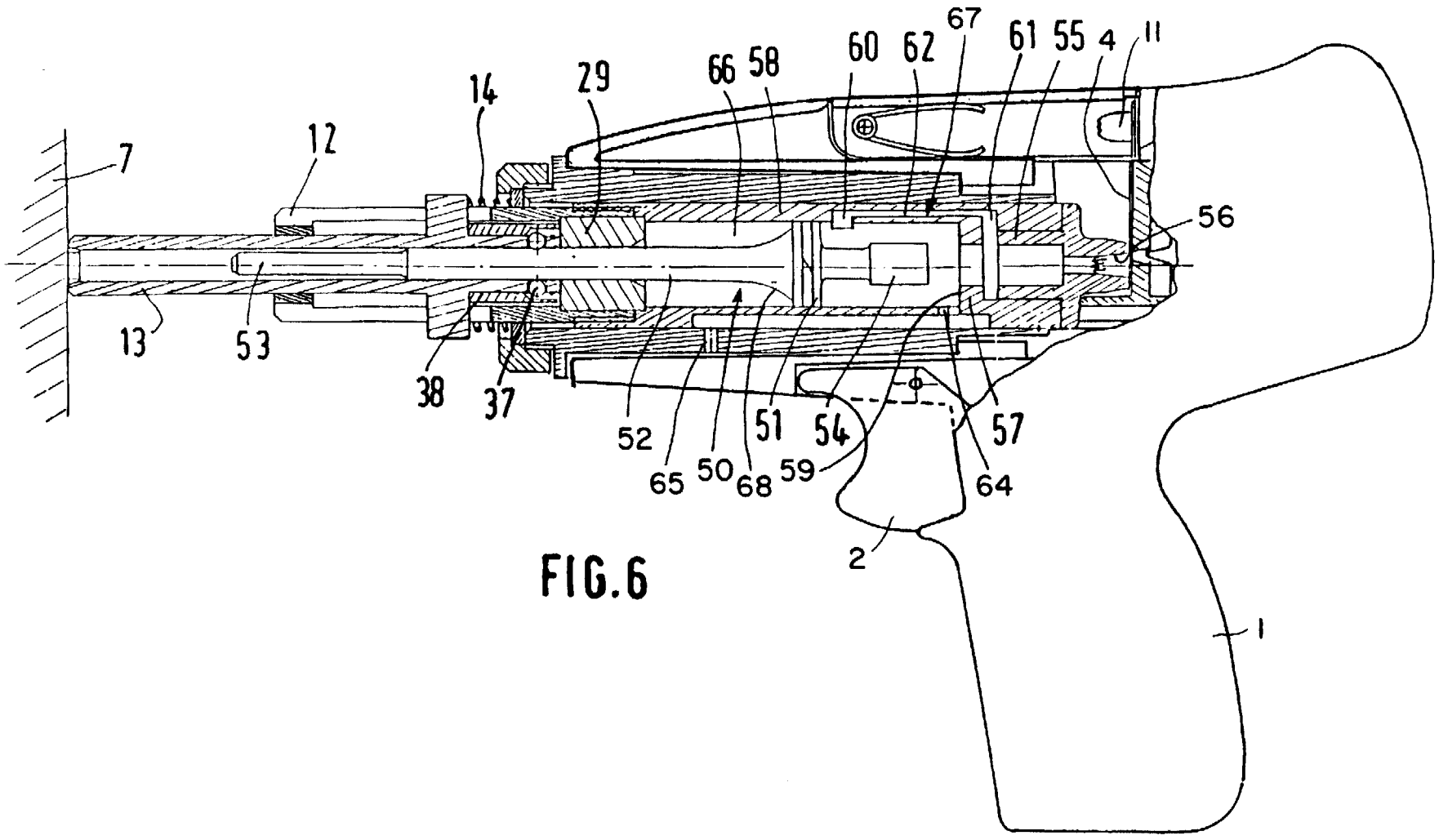
FIG. 6 is a view analogous to the preceding ones, just before return of the riser.

The variant embodiment of the apparatus of FIGS. 4 to 6 differs from the first embodiment of FIGS. 1 to 3 only by its drive assembly 5. The riser 50 includes a head 51 extended towards the front by a rod 52 having a tapered front portion 53 and towards the rear by a lengthening piece 54 with a smaller section than that of the head 51.

A cartridge holder 55 having an inner section at the front of the cartridge housing 56 substantially equal to that of the riser lengthening piece 54 is disposed at the rear of the barrel 9. However, this cartridge holder 55 and the barrel 9 could also be made in one piece.

In front of the cartridge holder 55, the barrel wall 57 has an oversize in the plane of which the inner section of the barrel 9 is equal to that of the cartridge holder 55 and together with the front barrel part 56 forms an annular stop shoulder 59 for the riser head 51.

A passage 62 opening into the bore of the barrel 9, at the front, by a front opening 60 and, at the rear, by a rear opening 61, is formed in the wall of the barrel 9, extending partially into the port ion of small thickness 58 and partially into the oversize portion 57. As in the other embodiment, the barrel 9 includes a longitudinal annular outer lateral recess 63 opening into the bore of the barrel 9 by a passage 64 in the barrel 9 and to the exterior of the apparatus by a passage 65 in the barrel holder 8.

The return chamber of the riser 50 in this case also includes a front space 66 at the front of the riser head 51 and its front surface 68 and a rear space 67 formed in this case by the communicating passage 60–62 along the riser 50. It will be noted that the axial length of the passage 62, apart from the dimensions of the openings 60, 61, is in this case substantially equal to the sum of the axial lengths of the riser 51, the bore of the cartridge holder 55 and double the axial length of the oversize of the barrel 57.

After firing (from positioning to firing, the operation is identical to that described hereinbefore), the gas pressure in the cartridge housing 56 rises and the riser 50 is propelled towards the front.

When the rear end of the riser lengthening piece 54 has travelled a first distance equal to the axial length of the inner bore of the cartridge holder 55, it uncovers the rear opening 61 of the passage 62, thereby bringing the front space 66 and the rear space 67 of the return chamber into communication with the combustion chamber 56.

The riser 50 continues to travel towards the front and when the riser head 51 arrives at the axial position at which the same is substantially coincident with the front opening 60 in the passage 62, the riser having travelled a second distance since the beginning of its propulsion, the riser head 51 covers the front opening 60, thereby separating the rear space 67 from the front space 66.

As hereinbefore, the riser 50 continues to travel towards the front, compressing the gases trapped in the front space 66 until the plug is fixed. The riser 50 is thus returned towards the rear under the pressure of the gases in the front space 66 and by virtue of the escape of the gases from the rear space 67 towards the exterior. Its complete return to the firing position is ensured as hereinbefore by the ring 38 and the balls 37.

In the first embodiment of FIGS. 1 to 3, the air cushion formed at the rear of the riser 50 after it returns towards the rear by the action of the balls 37 and the ring 38, is compressed to a volume substantially corresponding to that of the inner bore of the nozzle 16. In the second embodiment of FIGS. 4 to 6, the air cushion at the rear of the riser is compressed to a volume substantially corresponding to that of the cartridge housing 56, much smaller than that of the inner bore of the nozzle 16 of the first embodiment. The effort required to return the riser 50 completely towards the rear in the second embodiment is therefore greater than in the first embodiment. The riser 50 of the second embodiment will therefore no longer have a tendency to move back towards the front.

Obviously, many modifications and variations of the present invention are possible in light of the above teachings. It is therefore to be understood that within the scope of the appended claims, the present invention may be practiced otherwise than as specifically described herein.

We claim:

1. Apparatus for driving a fastener into a substrate, comprising:

a combustion chamber;

barrel means defining a longitudinal axis and having an inner peripheral wall defining an interior space therein;

first exhaust port means defined within said barrel means for fluidically connecting said interior space of said barrel means to exhaust space external of said barrel means;

second port means defined within said barrel means; and a riser, adapted to be driven by combustion gases developed within said combustion chamber so as to in turn drive a fastener into a substrate, having first means for engaging a fastener so as to drive a fastener into a substrate, having second means disposed within said barrel means so as to divide said interior space of said barrel means into a first upstream space and a second downstream space, and axially movable within said barrel means between a first axial position at which said second means of said riser prevents said first upstream space of said barrel means from being fluidically connected to said second downstream space of said barrel means whereby said combustion gases from said combustion chamber can act upon said riser so as to drive said riser in a downstream direction, a second axial position at which said second means of said riser cooperates with said second port means of said barrel means so as to permit said first upstream space of said barrel means to be fluidically connected to said second downstream space of said barrel means whereby said combustion gases from said combustion chamber can flow from said first upstream space of said barrel means into said second downstream space of said barrel means, and a third axial position at which said second means of said riser again prevents fluidic communication between said first upstream space of said barrel means and said second downstream space of said barrel means so as to cause said combustion gases disposed within said second downstream space of said barrel means to be compressed by said axial movement of said second means of said riser whereupon subsequent expansion of said compressed combustion gases within said second downstream space of said barrel means, said riser and said second means of said riser are automatically returned toward said first axial position while said combustion gases disposed within said first upstream space of said barrel means are exhausted through said first exhaust port means of said barrel means.

2. The apparatus as set forth in claim 1, wherein:

said first means of said riser comprises a riser rod; and said second means of said riser comprises a riser head integrally formed upon one end of said riser rod which is disposed opposite a second end of said riser rod which is adapted to engage a fastener to be driven into a substrate.

3. The apparatus as set forth in claim 2, wherein:

said combustion chamber is defined within said barrel means;

said barrel means includes a sleeve member extending axially downstream from said combustion chamber; and said riser head has an axially extending skirt portion for accommodating said sleeve member of said barrel means whereby said riser head is slidably guided during its axial movement from said first axial position to said second axial position.

4. The apparatus as set forth in claim 3, further comprising:

passageway means defined within said skirt portion of said riser for fluidically connecting said combustion chamber with said first upstream space of said barrel means when said riser is disposed at said second axial position.

5. The apparatus as set forth in claim 2, wherein:

said riser head has a predetermined axial extent; and said second port means defined within said barrel means comprises at least one groove defined upon said inner peripheral wall of said barrel means and having an axial extent which is greater than said predetermined axial extent of said riser head such that when said riser head is disposed at said second axial position, which corresponds to the location of said second port means within said barrel means, said at least one groove of said second port means bridges said riser head so as to fluidically connect said first upstream space of said barrel means with said second downstream space of said barrel means.

6. The apparatus as set forth in claim 5, wherein:

said at least one groove comprises a plurality of grooves disposed circumferentially about said inner peripheral wall of said barrel means.

7. The apparatus as set forth in claim 2, wherein:

said combustion chamber is defined within said barrel means;

said barrel means includes a sleeve member extending axially downstream from said combustion chamber; and said riser head has an axially extending extension portion for disposition within said sleeve member of said barrel means when said riser is disposed at said first axial position so as to be slidably guided during its axial movement from said first axial position to said second axial position.

8. The apparatus as set forth in claim 7, wherein:

said second port means defined within said barrel means comprises a pair of axially spaced, radially extending passageways and an axially extending passageway interconnecting said pair of axially spaced, radially extending passageways; and said riser head and said extension portion have an axial extent which is less than the axial extent defined between said axially spaced, radially extending passageways such that when said riser is disposed at said second axial position, said pair of axially spaced, radially extending passageways and said axially extending passageway interconnecting said pair of axially spaced, radially extending passageways bridge said riser head and said extension portion so as to fluidically connect said first upstream space of said barrel means with said second downstream space of said barrel means.

9. Apparatus for driving a fastener into a substrate, comprising:

a combustion chamber;

barrel means defining a longitudinal axis and having an inner peripheral wall defining an interior space therein;

first exhaust port means defined within said barrel means for fluidically connecting said interior space of said barrel means with exhaust space external of said barrel means;

second port means defined within said barrel means; and a riser, adapted to be driven by combustion gases developed within said combustion chamber so as to in turn drive a fastener into a substrate, having first means for engaging a fastener so as to drive a fastener into a substrate, having second means slidably engaged with said inner peripheral wall of said barrel means so as to divide said interior space of said barrel means into a first upstream space and a second downstream space, and axially movable within said barrel means between a first axial position at which said second means of said riser prevents said first upstream space of said barrel means from being fluidically connected to said second downstream space of said barrel means whereby said combustion gases from said combustion chamber can act upon said riser so as to drive said riser in a downstream direction such that said riser can drive a fastener into a substrate, a second axial position at which said second means of said riser cooperates with said second port means of said barrel means so as to permit said first upstream space of said barrel means to be fluidically connected to said second downstream space of said barrel means whereby said combustion gases of said combustion chamber can flow from said first upstream space of said barrel means into said second downstream space of said barrel means, and a third axial position at which said second means of said riser again prevents fluidic communication between said first upstream space of said barrel means and said second downstream space of said barrel means, but permits fluidic communication between said first upstream space of said barrel means and said first exhaust port means of said barrel means, so as to cause said combustion gases disposed within said second downstream space of said barrel means to be compressed by said axial movement of said second means of said riser whereupon subsequent expansion of said compressed combustion gases within said second downstream space of said barrel means, and exhaust of said combustion gases within said first upstream space of said barrel means out through said first exhaust port means of said barrel means, said riser and said second means of said riser are automatically returned toward said first axial position.

10. The apparatus as set forth in claim 9, wherein:

said first means of said riser comprises a riser rod; and said second means of said riser comprises a riser head integrally formed upon a first end of said riser rod which is disposed opposite a second end of said riser rod which is adapted to engage a fastener to be driven into a substrate.

11. The apparatus as set forth in claim 10, wherein:

said combustion chamber is defined within said barrel means;

said barrel means includes a sleeve member extending axially downstream from said combustion chamber; and said riser head has an axially extending skirt portion for enveloping said sleeve member of said barrel means whereby said riser head is slidably guided within said barrel means during its axial movement from said first axial position to said second axial position.

12. The apparatus as set forth in claim 11, further comprising:

passageway means defined within said skirt portion of said riser for fluidically connecting said combustion chamber with said first upstream space of said barrel means when said riser is disposed at said second axial position.

13. The apparatus as set forth in claim 10, wherein:

said riser head has a predetermined axial extent; and said second port means defined within said barrel means comprises at least one groove defined upon said inner peripheral wall of said barrel means and having an axial extent which is greater than said predetermined axial extent of said riser head such that when said riser head is disposed at said second axial position, which corresponds to the axial location of said second port means within said barrel means, said at least one groove of said second port means bridges said riser head so as to fluidically connect said first upstream space of said barrel means with said second downstream space of said barrel means.

14. The apparatus as set forth in claim 13, wherein:

said at least one groove comprises a plurality of grooves circumferentially spaced about said inner peripheral wall of said barrel means.

15. The apparatus as set forth in claim 10, wherein:

said combustion chamber is defined within said barrel means;

said barrel means includes a sleeve member extending axially downstream from said combustion chamber; and said riser head has an axially extending extension portion for disposition within said sleeve member of said barrel means when said riser is disposed at said first axial position so as to be slidably guided during its axial movement from said first axial position to said second axial position.

16. The apparatus as set forth in claim 15, wherein:

said second port means defined within said barrel means comprises a pair of axially spaced, radially extending passageways and an axially extending passageway interconnecting said pair of axially spaced, radially extending passageways; and said riser head and said extension portion have an axial extent which is less than the axial extent defined between said axially spaced, radially extending passageways such that when said riser is disposed at said second axial position, said pair of axially spaced, radially extending passageways and said axially extending passageway interconnecting said pair of axially spaced, radially extending passageways bridge said riser head and said extension portion so as to fluidically connect said first upstream space of said barrel means with said second downstream space of said barrel means.

* * * * *